US011097402B2

(12) United States Patent
Machinchick et al.

(10) Patent No.: US 11,097,402 B2
(45) Date of Patent: Aug. 24, 2021

(54) NOTCHED LINE RUNNER SOCKET

(71) Applicant: Ford Motor Company, Dearborn, MI (US)

(72) Inventors: Zachary Machinchick, Dearborn, MI (US); Joshua Norwood, Detroit, MI (US); Douglas Michael Smith, Ypsilanti, MI (US); Adam Wirth, Belleville, MI (US)

(73) Assignee: Ford Motor Company, Dearborn, MI (US)

( * ) Notice: Subject to any disclaimer, the term of this patent is extended or adjusted under 35 U.S.C. 154(b) by 332 days.

(21) Appl. No.: 16/173,401

(22) Filed: Oct. 29, 2018

(65) Prior Publication Data

US 2020/0130148 A1 Apr. 30, 2020

(51) Int. Cl.

| | |
|---|---|
| ***B25B 13/48*** | (2006.01) |
| ***B25B 13/46*** | (2006.01) |
| ***B25B 17/00*** | (2006.01) |

(52) U.S. Cl.

CPC ..... *B25B 13/481* (2013.01); *B25B 13/467* (2013.01); *B25B 17/00* (2013.01)

(58) Field of Classification Search

CPC ..... B25B 13/481; B25B 13/467; B25B 17/00; B25B 13/04; B25B 13/06; B25B 13/48; B25B 23/0071; B25B 13/065; B25B 13/46

See application file for complete search history.

(56) References Cited

U.S. PATENT DOCUMENTS

| | | | | |
|---|---|---|---|---|
| 2,693,728 | A * | 11/1954 | Shaff | B25B 21/002 81/57.13 |
| 4,506,567 | A | 3/1985 | Makhlouf | |
| 5,339,710 | A | 8/1994 | Deadmond et al. | |
| 5,392,671 | A * | 2/1995 | Hazzard | B25B 13/481 81/57.13 |
| 5,927,156 | A | 7/1999 | Landwehr, III | |
| 7,080,581 | B2 * | 7/2006 | Reese | B25B 13/06 81/124.2 |
| 7,204,174 | B1 | 4/2007 | Wood | |
| 7,721,627 | B2 * | 5/2010 | Basham | B25C 7/00 81/57.14 |
| 9,802,297 | B2 * | 10/2017 | Marchand | B25B 13/065 |
| 2008/0245193 | A1 | 10/2008 | Lipka | |

(Continued)

FOREIGN PATENT DOCUMENTS

| | | |
|---|---|---|
| JP | H0819968 | 1/1996 |

OTHER PUBLICATIONS

ECS Tuning, Injection Line Wrench—12-point Socket, Product page, available at URL https://www.ecstuning.com/b-hazet-parts/injection-line-wrench-12-point-socket/hz45502~haz/.

(Continued)

*Primary Examiner* — Robert J Scruggs
(74) *Attorney, Agent, or Firm* — Burris Law, PLLC

(57) ABSTRACT

A socket assembly includes a socket head, an input member, and a plurality of transfer members. The socket head is disposed about an axis and defines an aperture extending axially through the socket head and through a side of the socket head. The socket head includes external teeth. The input member is coaxial with the socket head. Each transfer member includes a first end drivingly coupled to the input member and a second end configured to engage the external teeth.

18 Claims, 4 Drawing Sheets

(56) References Cited

U.S. PATENT DOCUMENTS

2012/0260776 A1* 10/2012 Ridge ..... B25B 13/481
81/57.29

OTHER PUBLICATIONS toolsid.com, Schley Products® ?13400-12-Point ⅜" Drive Injector Line Socket Set, Product page, available at URL https://www.carid.com/schley-products/bmw-injector-line-sockets-for-n54-n63-and-s63-mpn-13400.html.

Atlas Copco, ETO DS Tube Nut Nutrunner product page, available at URL https://www.flexibleassembly.com/Products/DC-Electric-Nutrunners/Atlas-Copco-ETO-DS-Nutrunners.

* cited by examiner

NOTCHED LINE RUNNER SOCKET

FIELD

The present disclosure relates to a notched line runner socket.

BACKGROUND

The statements in this section merely provide background information related to the present disclosure and may not constitute prior art.

Some fluid conduits (e.g., hoses, tubes, or pipes) include fittings for connecting the conduit to a device or to another conduit. Such conduits extend coaxially through the top end of the nut and can bend off from the nut axis. In some applications, such as when the conduit is an air or brake line of a vehicle, it can be difficult to access the nut of the fitting to tighten the fitting onto its intended target. Typical wrenches can be too large to access the nut in tight spaces, while standard sockets cannot accommodate the coaxial conduit. Typical notched sockets are solid bodies that must be reset at least once every rotation to avoid hitting the bent part of the conduit. Other socket devices require the tool that connects to the socket to be offset from the nut axis, which can require additional space or can make it difficult to keep axial pressure on the nut.

These issues related to the use of a socket on conduit fittings are addressed by the present disclosure.

SUMMARY

In one form, socket assembly includes a socket head, an input member, and a plurality of transfer members. The socket head is disposed about an axis and defines an aperture extending axially through the socket head and through a side of the socket head. The socket head includes external teeth. The input member is coaxial with the socket head. Each transfer member includes a first end drivingly coupled to the input member and a second end configured to engage the external teeth. In a variety of alternate forms of the present disclosure: the socket head defines a fastener cavity having a predetermined shape and being open through a bottom side of the socket head to receive a fastener having a mating predetermined shape; the aperture of the socket head is open to the fastener cavity through a top side of the socket head; the input member includes a plurality of teeth and the first end of each transfer member is meshingly engaged with teeth of the input member; each transfer member is a shaft that is offset from and parallel to the axis of the input member and the socket head; the socket assembly further includes a frame rotatably supporting the socket head, the input member, and the transfer members; the frame defines a line cavity axially between the input member and the socket head; the line cavity being open through a side of the frame and configured to be open to the aperture when the socket head is in a first rotational position; a gear ratio between the input member and the socket head is variable; either the input member or the transfer members are axially translatable between a first position and a second position relative to the other of the input member or the transfer members; when in the first position, the first ends of the transfer members engage the input member with a first gear ratio; when in the second position, the first ends of the transfer members engage the input member with a second gear ratio that is different from the first gear ratio; the transfer members are axially translatable between a first position and a second position relative to the socket head; when in the first position, the second ends of the transfer members engage the teeth of the socket head with a first gear ratio; when in the second position, the second ends of the transfer members engage the teeth of the socket head with a second gear ratio that is different from the first gear ratio; the input member defines a recess having a predetermined shape configured to matingly receive a driver member of a tool; the external teeth are disposed about a perimeter of the socket head;

In another form, a socket assembly includes a socket head, an input member, and a plurality of shafts. The socket head is rotatable about an axis and defines a socket cavity open through a top, a bottom, and a side of the socket head. The input member is offset in an axial direction from the socket head. Each shaft includes a first end meshingly engaged to teeth on the input member and a second end configured to meshingly engage teeth on the socket head. In a variety of alternate forms of the present disclosure: the socket assembly further includes a frame rotatably supporting the socket head, the input member, and the shafts; the frame defines a line cavity axially between the input member and the socket head; the line cavity is open through a side of the frame and open to the socket cavity when the socket head is in a first rotational position; the input member is coaxial with the axis; the shafts are parallel to the axis; a gear ratio between the input member and the socket head is variable; either the input member or the shafts are axially translatable between a first position and a second position relative to the other of the input member or the shafts; when in the first position, the first ends of the shafts engage the input member with a first gear ratio; when in the second position, the first ends of the shafts engage the input member with a second gear ratio that is different from the first gear ratio; the shafts are axially translatable between a first position and a second position relative to the socket head; when in the first position, the second ends of the shafts engage the teeth of the socket head with a first gear ratio; when in the second position, the second ends of the shafts engage the teeth of the socket head with a second gear ratio that is different from the first gear ratio; the input member defines a recess having a predetermined shape configured to matingly receive a driver member of a tool.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
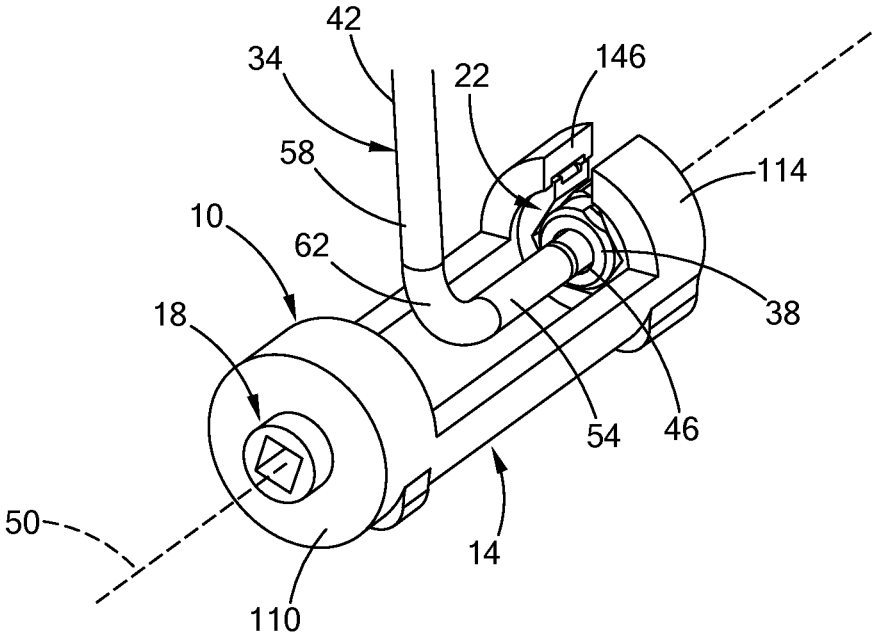
FIG. 1 is a top perspective view of a socket in accordance with the teachings of the present disclosure, illustrated with a head of the socket engaging a nut of a line assembly.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

With reference to FIGS. 1-4, a socket assembly 10 is illustrated. The socket assembly 10 includes a frame 14, an input member 18, an output member 22, a first transfer member (e.g., first shaft 26), and a second transfer member (e.g., second shaft 30). The socket assembly 10 can be constructed in any suitable manner, including assembly from separate parts or 3*d* printed in its assembled state. In FIG. 1, the socket assembly 10 is illustrated with a line nut assembly 34 that includes a nut 38 and a conduit 42. The nut 38 can be a hex nut, as shown, or have another external shape configured to be engaged by the output member 22. The nut 38 is configured to be threaded onto a mating fluid connector (not shown, e.g., a fluid port or a mating connector of a corresponding second conduit). The mating fluid connector (not shown) has external threads configured to mate with the internal threads (not specifically shown) of the nut 38. The top of the nut 38 defines a nut aperture 46 coaxial with a rotational axis 50 of the nut 38.

The conduit 42 is a fluid conduit, such as a rigid pipe or a flexible hose for example. The conduit 42 is hollow such that a fluid (e.g., a liquid or a gas) can flow through it. One end of the conduit 42 extends through the nut aperture 46 and the nut is configured to secure the conduit 42 to the mating connector (not shown) so that the conduit 42 is in fluid communication with the flow path of the mating connector (not shown). In the example provided, the conduit 42 is a rigid pipe that has a proximal portion 54 that extends coaxially from the end by a first distance and is coupled to a distal portion 58 by a bend portion 62. In the example provided, the bend portion 62 is a 90 degree elbow such that the distal portion 58 extends therefrom at perpendicular angle relative to the rotational axis 50, though the bend portion 62 can be configured at other angles.

Figure 2:
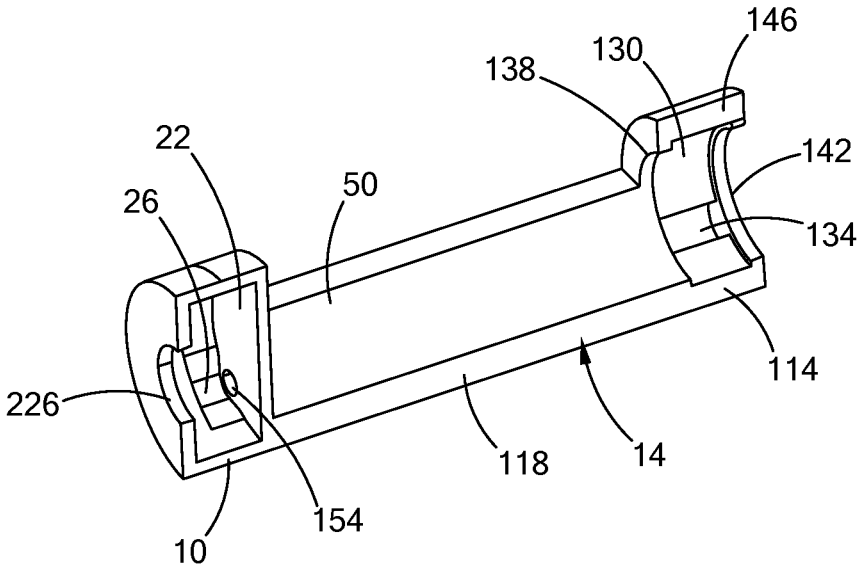
FIG. 2 is a perspective cross-sectional view of a frame of the socket of FIG. 1.

Referring to FIG. 2, the frame 14 includes a top housing 110, a bottom housing 114, and a connecting body 118. It is understood that the frame 14 shown in FIGS. 1 and 2 is symmetrical across the plane used for the cross-section of FIG. 2. The top housing 110 forms a shell that defines an input cavity 122 and a pair of first recesses 126 (only one of which is shown in FIG. 2). In the example provided, the input cavity 122 is a cylindrical cavity disposed coaxially about the axis 50. The first recesses 126 are open to the input cavity 122 and extend radially outward of the input cavity 122. The input cavity 122 is open through the top of the top housing 110.

The bottom housing 114 is spaced apart from the top housing 110 along the axis 50 and forms a shell that defines an output cavity 130 and a pair of second recesses 134 (only one of which is shown in FIG. 2). In the example provided, the output cavity 130 is a cylindrical cavity disposed coaxially about the axis 50. The second recesses 134 are open to the output cavity 130 and extend radially outward of the output cavity 130. The output cavity 130 is open through the top and bottom of the bottom housing 114 via apertures 138 and 142, which are respectively defined by the top and bottom walls of the bottom housing 114. The output cavity 130 extends radially outward of the apertures 138, 142. In the example provided, the apertures 138, 142 are cylindrical and the same size, though other configurations can be used. The aperture 142 through the bottom wall is large enough to receive the nut 38 (FIG. 1) therethrough. In an alternative configuration, the aperture 138 through the top wall of the bottom housing 114 can be a different shape and/or can be smaller than the aperture 142, while still being large enough to receive the conduit 42 (FIG. 1) therethrough.

The bottom housing 114 also defines a slot 146 open through a side of the bottom housing 114 and extending fully through the one side of the bottom housing 114. In other words, the slot 146 is open in the radial direction to permit movement of the conduit 42 in the radial direction from an exterior of the bottom housing 114 into the output cavity 130 and the slot 146 is open in the axial direction through the top and bottom walls of the bottom housing 114. Thus, the bottom housing 114 has a generally "C" shape or a discontinuous annular shape where the slot 146 forms the discontinuity in the annular shape.

The connecting body 118 extends axially between the top housing 110 and the bottom housing 114 to connect the two housings 110, 114 and rigidly support them spaced axially apart. The connecting body 118, the top housing 110, and the bottom housing 114 cooperate to define a conduit space 150 configured to receive the conduit 42 between the top and bottom housings 110, 114. The conduit space 150 is open to the output cavity 130 through the aperture 138 and open through the same side of the socket assembly 10 as the slot 146 to allow the conduit 42 to bend off the axis 50 and away from the socket assembly 10. In the example provided, the connecting body 118 is a discontinuous annular shape such that the connecting body 118 extends between the top and bottom housings 110, 114 along a side of the socket assembly 10 that is opposite the slot 146. In the example provided, the connecting body 118 defines a pair of shaft bores 154 (only one of which is shown in FIG. 2) that generally connect the input cavity 122 to the output cavity 130. Each shaft bore 154 connects one of the first recesses 126 to one of the second recesses 134.

Figure 3:
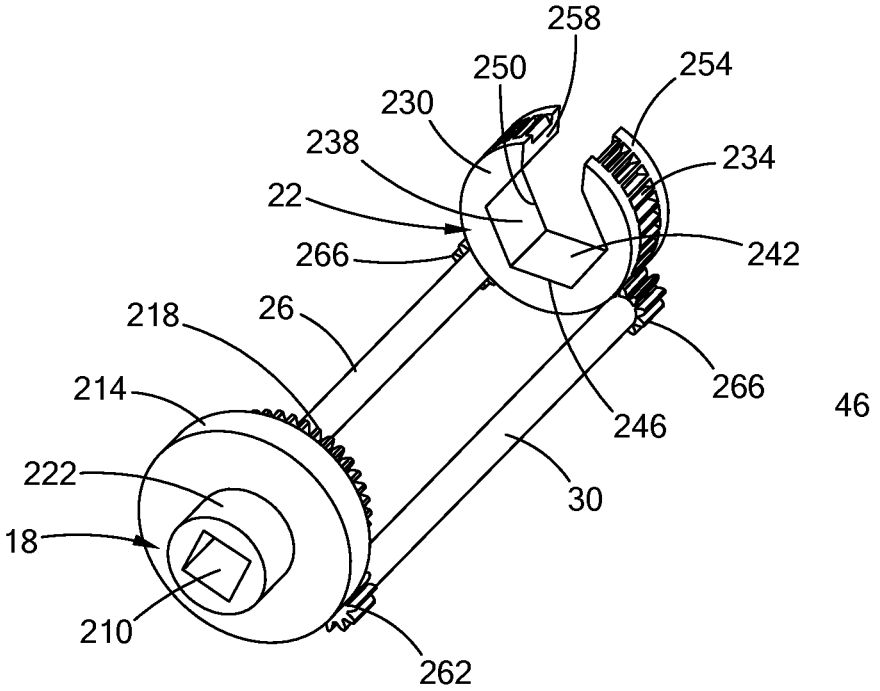
FIG. 3 is a top perspective view of a gearset of the socket of FIG. 1.
Figure 4:
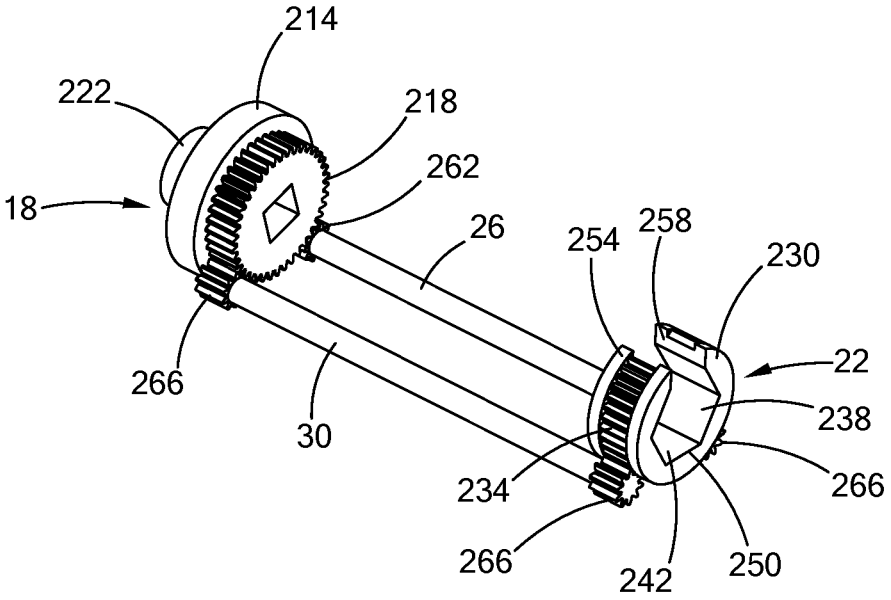
FIG. 4 is a bottom perspective view of the gearset of FIG. 3.

Referring to FIGS. 3 and 4, the input member 18 includes a tool recess or aperture 210, a cylinder 214, and an input gear 218. In the example provided, the tool aperture 210 is defined by a cylindrical boss 222 that extends coaxially from the cylinder 214. The tool aperture 210 has a predefined shape that is configured to receive and engage with a mating predefined shape of a corresponding tool (not shown; e.g., a square head of a ratchet wrench or socket driver). Alternatively, the boss 222 can have an exterior surface of a predefined shape configured to be received in a mating interior feature of the tool (not shown). In the example provided, the boss 222 extends through an aperture 226 (FIG. 2) in the top wall of the top housing 110 (FIG. 2).

The cylinder 214 is coaxial with the axis 50 and is disposed within the input cavity 122 (FIG. 2) and configured to rotate relative to the top housing 110 (FIG. 2). While not specifically shown, one or more bearings can optionally support the input member 18 for rotation within the top housing 110 (FIG. 2). The input gear 218 is coupled to the cylinder 214 for rotation therewith about the axis 50 and is coaxial with the axis 50. The input gear 218 is located on an opposite axial end of the cylinder 214 as the boss 222. The input gear 218 defines a plurality of teeth. In the example provided, the teeth of the input gear 218 are external spur gear teeth, though other configurations can be used. In the example provided, the input gear 218 has an outermost diameter that is less than the diameter of the cylinder.

The output member 22 includes a socket head 230 and an output gear 234. The socket head 230 is disposed coaxially about the axis 50 and includes a plurality of interior facing walls 238 arranged in a predetermined shape to define a socket cavity 242. The walls 238 are configured to mate with the exterior surface of the nut 38 (FIG. 1) to impart torque thereto. In the example provided, the walls 238 of the socket cavity 242 are arranged in a hexagonal pattern about the axis 50, though other shapes can be used depending on the mating nut 38 (FIG. 1). The socket cavity 242 is open through the top and bottom ends of the output member 22 via apertures 246 and 250. In the example provided, the apertures 246, 250 are the same size and shape as the socket cavity 242. In an alternative configuration, the aperture 246 through the top of the output member 22 can be a different shape (e.g., cylindrical) and can be smaller than the socket cavity 242, while still being large enough to receive the conduit 42 (FIG. 1) therethrough.

The output gear 234 is coupled to the socket head 230 for rotation therewith about the axis 50. The output gear 234 includes a plurality of teeth disposed about the axis 50. In the example provided, the teeth are external spur gear teeth, though other configurations can be used. In the example provided, the teeth are formed about the perimeter of the socket head 230, but are configured to have a maximum diameter that is less than or equal to the diameter of the cylindrical outer surface 254 of the socket head 230.

The output member 22 also defines a slot 258 open through a side of the output member 22 and extending fully through the one side of the output member 22 (i.e., through the socket head 230 and the output gear 234). In other words, the slot 258 is open in the radial direction to permit movement of the conduit 42 (FIG. 1) in the radial direction from an exterior of the output member 22 into the socket cavity 242 and the slot 258 is open in the axial direction through the top and bottom of the output member 22. Thus, the output member 22 has a generally "C" shape or a discontinuous annular shape where the slot 258 forms the discontinuity in the annular shape, similar to the bottom housing 114.

The output member 22 is coaxial with the axis 50 and disposed within the output cavity 130 (FIG. 2) and configured to rotate relative to the bottom housing 114 (FIG. 2). While not specifically shown, one or more bearings can optionally support the output member 22 for rotation within the bottom housing 114 (FIG. 2). The slot 258 of the output member 22 is configured to align with the slot 146 of the bottom housing 114 when the output member 22 is in a first rotational position, shown in FIG. 1.

The first and second shaft 26, 30 each includes an input transfer gear 262 and an output transfer gear 266. The input transfer gears 262 are disposed at one end of their corresponding shaft 26, 30 and meshingly engaged with the input gear 218, while the output transfer gears 266 are disposed at the opposite end of the corresponding shaft 26, 30 and meshingly engaged with the output gear 234. In the example provided, the input transfer gears 262 are disposed partially within the first recesses 126 and the output transfer gears 266 are disposed partially within the second recesses 134. Each of the shafts 26, 30 extends axially through a corresponding one of the shaft bores 154 and is rotatable relative to the frame 14. While not specifically shown, the shafts 26, 30 can be optionally supported for rotation relative to the frame 14 by bearings. In an alternative configuration, not specifically shown, the connecting body be arranged such that it does not include the shaft bores 154 and the shafts 26, 30 extend through the bottom of the top housing 110 and the top of the bottom housing 114, but are external to the connecting body 118.

Referring to FIGS. 1-3, the socket assembly 10 is operated by first aligning the slots 146, 258, then moving the socket assembly 10 so that the proximal portion 54 of the conduit 42 is moved through the slots 146, 258 and into the socket cavity 242. The socket assembly 10 is then moved axially toward the nut 38 until the nut is received in the socket cavity 242, as shown in FIG. 1. The tool (not shown) is attached to the tool aperture 210 and operated to drive the rotation of the output member 22 and rotation of the nut 38.

Figure 5:
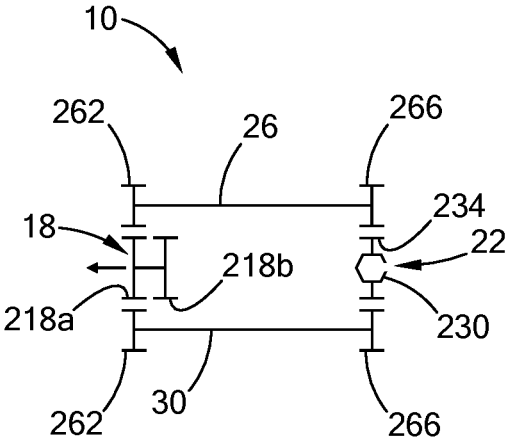
FIG. 5 is a schematic view of a socket of a second construction in accordance with the teachings of the present disclosure.

In an alternative construction, the socket assembly 10 can have a variable gear ratio between the input member 18 and the output member 22. In one such configuration, schematically shown in FIG. 5, the input member 18 includes a first input gear 218*a* and a second input gear 218*b* axially adjacent to each other. The first and second input gears 218*a* and 218*b* are similar to the input gear 218 (FIGS. 3 and 4) and have a similar diameter to each other, but different numbers of teeth relative to each other. The input member 18 and the frame 14 (FIGS. 1 and 2) are configured to permit the input member 18 to move axially relative to the shafts 26, 30 between a first position wherein the input transfer gears 262 engage the first input gear 218*a* and a second position wherein the input transfer gears 262 engage the second input gear 218*b*.

Figure 6:
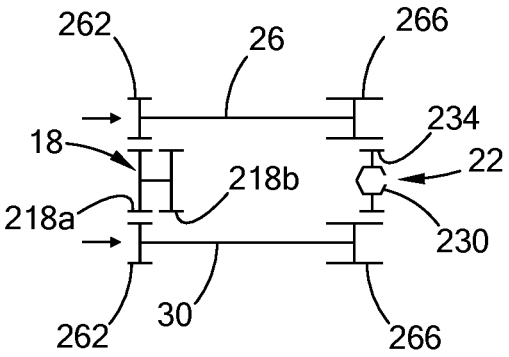
FIG. 6 is a schematic view of a socket of a third construction in accordance with the teachings of the present disclosure.

Alternatively, as shown in FIG. 6, the shafts 26, 30 and the frame 14 (FIGS. 1 and 2) are configured to permit the shafts 26, 30 to move axially relative to the input member 18 between a first position wherein the input transfer gears 262 engage the first input gear 218*a* and a second position wherein the input transfer gears 262 engage the second input gear 218*b*. The output transfer gears 266 are configured to remain engaged with the output gear 234 when in the first and second positions.

Figure 7:
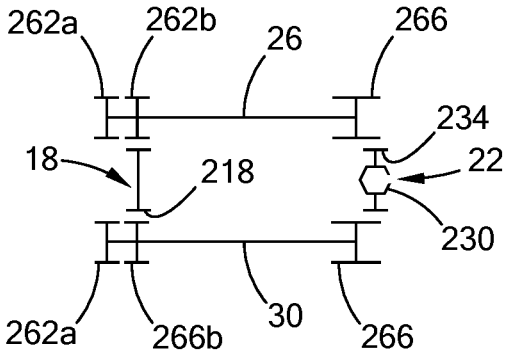
FIG. 7 is a schematic view of a socket of a fourth construction in accordance with the teachings of the present disclosure.

In yet another alternative construction, shown in FIG. 7, the shafts 26, 30 have two input transfer gears 262*a* and 262*b* axially adjacent to each other. The first and second input transfer gears 262*a* and 262*b* are similar to the input transfer gear 262 (FIGS. 3 and 4) and have a similar diameter to each other, but different numbers of teeth relative to each other. The shafts 26, 30 and the frame 14 (FIGS. 1 and 2) are configured to permit the shafts 26, 30 to move axially relative to the input member 18 between a first position wherein the first input transfer gears 262*a* engage the input gear 218 and a second position wherein the second input transfer gears engage 262*b* the input gear 218. The output transfer gears 266 are configured to remain engaged with the output gear 234 when in the first and second positions.

Alternatively, the input member 18 and the frame 14 (FIGS. 1 and 2) can be configured to permit the input member 18 to move axially relative to the shafts 26, 30 between a first position wherein the first input transfer gears 262*a* engage the input gear 218 and a second position wherein the second input transfer gears 262*b* engage the input gear 218.

Figure 8:
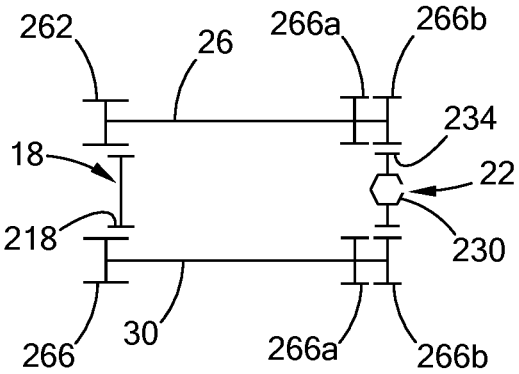
FIG. 8 is a schematic view of a socket of a fifth construction in accordance with the teachings of the present disclosure.

In still alternative construction, shown in FIG. 8, the shafts 26, 30 have two output transfer gears 266*a* and 266*b* axially adjacent to each other. The first and second output transfer gears 266*a* and 266*b* are similar to the output transfer gear 266 (FIGS. 3 and 4) and have a similar diameter to each other, but different numbers of teeth relative to each other. The shafts 26, 30 and the frame 14 (FIGS. 1 and 2) are configured to permit the shafts 26, 30 to move axially relative to the output member 22 between a first position wherein the first output transfer gears 266*a* engage the output gear 234 and a second position wherein the second output transfer gears 266*b* engage the output gear 234. The input transfer gears 262 are configured to remain engaged with the input gear 218 when in the first and second positions.

Alternatively, the output member 22 and the frame 14 (FIGS. 1 and 2) can be configured to permit the output member 22 to move axially relative to the shafts 26, 30 between a first position wherein the first output transfer gears 266*a* engage the output gear 234 and a second position wherein the second output transfer gears 266*b* engage the output gear 234.

Figure 9:
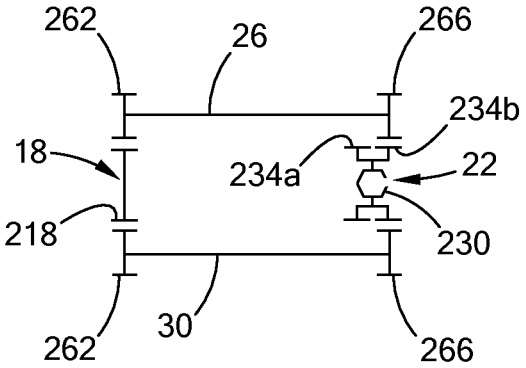
FIG. 9 is a schematic view of a socket of a sixth construction in accordance with the teachings of the present disclosure.

In another alternative configuration, shown in FIG. 9, the output member 22 includes a first output gear 234*a* and a second output gear 234*b* axially adjacent to each other. The first and second output gears 234*a* and 234*b* are similar to the output gear 234 (FIGS. 3 and 4) and have a similar diameter to each other, but different numbers of teeth relative to each other. The output member 22 and the frame 14 (FIGS. 1 and 2) is configured to permit the output member 22 to move axially relative to the shafts 26, 30 between a first position wherein the output transfer gears 266 engage the first output gear 234*a* and a second position wherein the output transfer gears 266 engage the second output gear 234*b*.

Alternatively, the shafts 26, 30 and the frame 14 (FIGS. 1 and 2) can be configured to permit the shafts 26, 30 to move axially relative to the output member 22 between a first position wherein the output transfer gears 266 engage the first output gear 234*a* and a second position wherein the output transfer gears 266 engage the second output gear 234*b*. The input transfer gears 262 are configured to remain engaged with the input gear 218 when in the first and second positions.

Figure 10:
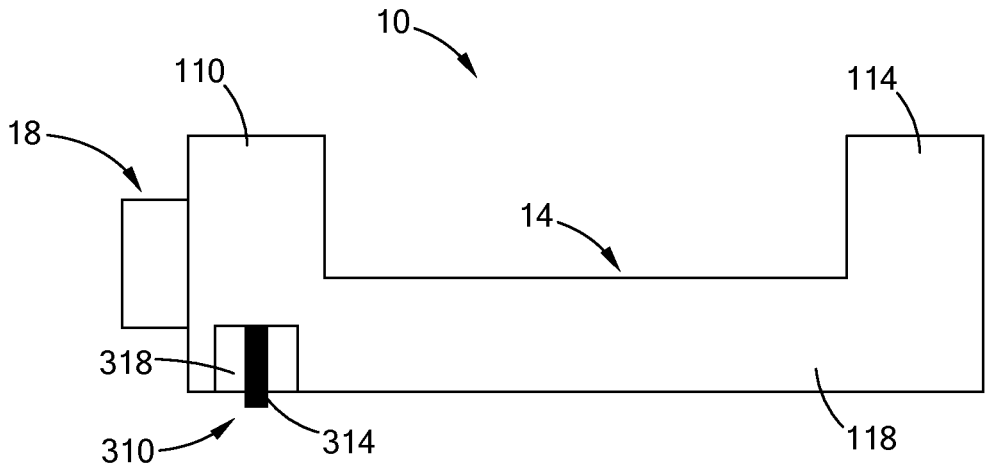
FIG. 10 is a side view of a socket having a manual switch in accordance with the teachings of the present disclosure.
Figure 11:
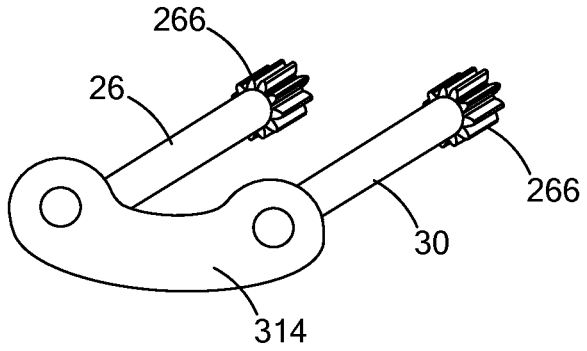
FIG. 11 is a perspective view of the switch of FIG. 10.
Figure 12:
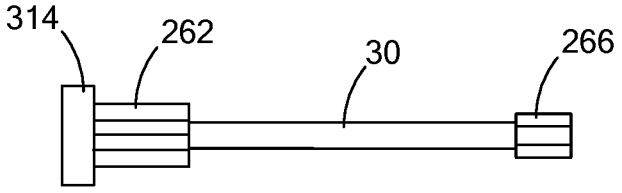
FIG. 12 is a side view of a portion of the socket of FIG. 10, illustrating the switch and a shaft of the socket in accordance with the teachings of the present disclosure.

For any of the preceding configurations shown in FIGS. 5-9, the switching between first and second positions can be achieved by any suitable means, such as a lever or switch that can be actuated from the exterior of the frame 14 (FIGS. 1 and 2). The lever or switch can be manually moved by a user or the socket assembly 10 can be switched between the first and second positions via an actuator such as a solenoid for example. With reference to FIGS. 10-12, one non-limiting example of a manual switch is illustrated and identified with reference numeral 310. In the example provided, the switch 310 includes a body or plate 314 that is coupled to both shafts 26, 30 for common axial translation with the shafts 26, 30. The shafts 26, 30 are rotatable relative to the plate 314. The plate extends through an aperture 318 in the frame 14 to be accessible from the exterior of the frame 14. The example shown in FIGS. 10 and 11 can correspond to any of the configurations of FIGS. 6-9 where the shafts move relative to the frame 14. While not specifically shown, a similar switch can be attached to the input member 18 (FIGS. 5-7) or the output member 22 (FIG. 8 or 9) and extend exterior of the frame 14 in order to permit a user to axially move the input or output member 18 or 22 while still permitting rotation of the input or output member 18 or 22.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A socket assembly comprising:

a socket head disposed about an axis and defining an aperture extending axially through the socket head and through a side of the socket head, the socket head including external teeth;

an input member coaxial with the socket head;

a plurality of transfer members, each transfer member including a first end drivingly coupled to the input member and a second end configured to engage the external teeth; and a frame rotatably supporting the socket head, the input member, and the transfer members, the frame supporting the socket head and the input member for rotation about the axis.

2. The socket assembly of claim 1, wherein the socket head defines a fastener cavity having a predetermined shape and being open through a bottom side of the socket head to receive a fastener having a mating predetermined shape, the aperture of the socket head being open to the fastener cavity through a top side of the socket head.

3. The socket assembly of claim 1, wherein the input member includes a plurality of teeth and the first end of each transfer member is meshingly engaged with teeth of the input member.

4. The socket assembly of claim 1, wherein each transfer member is a shaft that is offset from and parallel to the axis of the input member and the socket head.

5. The socket assembly of claim 1, wherein the frame defines a line cavity axially between the input member and the socket head, the line cavity being open through a side of the frame and configured to be open to the aperture when the socket head is in a first rotational position.

6. The socket assembly of claim 1, wherein a gear ratio between the input member and the socket head is variable.

7. The socket assembly of claim 6, wherein either the input member or the transfer members are axially translatable between a first position and a second position relative to the other of the input member or the transfer members, wherein when in the first position the first ends of the transfer members engage the input member with a first gear ratio, wherein when in the second position, the first ends of the transfer members engage the input member with a second gear ratio that is different from the first gear ratio.

8. The socket assembly of claim 6, wherein the transfer members are axially translatable between a first position and a second position relative to the socket head, wherein when in the first position the second ends of the transfer members engage the teeth of the socket head with a first gear ratio, wherein when in the second position, the second ends of the transfer members engage the teeth of the socket head with a second gear ratio that is different from the first gear ratio.

9. The socket assembly of claim 1, wherein the input member defines a recess having a predetermined shape configured to matingly receive a driver member of a tool.

10. The socket assembly of claim 1, wherein the external teeth are disposed about a perimeter of the socket head.

11. A socket assembly comprising:

a socket head rotatable about an axis and defining a socket cavity open through a top, a bottom, and a side of the socket head;

an input member offset in an axial direction from the socket head, the axial direction being one of two axial directions of the axis;

a plurality of shafts, each shaft including a first end meshingly engaged to teeth on the input member and a second end configured to meshingly engage teeth on the socket head, the first end being offset in the axial direction from the second end; and a frame rotatably supporting the socket head, the input member, and the shafts.

12. The socket assembly of claim 11, wherein the frame defines a line cavity axially between the input member and the socket head, the line cavity being open through a side of the frame and open to the socket cavity when the socket head is in a first rotational position.

13. The socket assembly of claim 11, wherein the input member is coaxial with the axis.

14. The socket assembly of claim 13, wherein the shafts are parallel to the axis.

15. The socket assembly of claim 11, wherein a gear ratio between the input member and the socket head is variable.

16. The socket assembly of claim 15, wherein either the input member or the shafts are axially translatable between a first position and a second position relative to the other of the input member or the shafts, wherein when in the first position the first ends of the shafts engage the input member with a first gear ratio, wherein when in the second position, the first ends of the shafts engage the input member with a second gear ratio that is different from the first gear ratio.

17. The socket assembly of claim 15, wherein the shafts are axially translatable between a first position and a second position relative to the socket head, wherein when in the first position the second ends of the shafts engage the teeth of the socket head with a first gear ratio, wherein when in the second position, the second ends of the shafts engage the teeth of the socket head with a second gear ratio that is different from the first gear ratio.

18. The socket assembly of claim 11, wherein the input member defines a recess having a predetermined shape configured to matingly receive a driver member of a tool.

* * * * *